US011851311B2

(12) United States Patent
Chintalapallipatta et al.

(10) Patent No.: US 11,851,311 B2
(45) Date of Patent: Dec. 26, 2023

(54) AUTONOMOUS PAYLOAD HANDLING APPARATUS

(71) Applicant: Tata Consultancy Services Limited, Mumbai (IN)

(72) Inventors: Venkat Raju Chintalapallipatta, Bangalore (IN); Venkatesh Prasad Bangalore Srinivas, Bangalore (IN); Pradeep Prabhakar Kamble, Bangalore (IN); Sri Sai Shyam Siddharth Gollu, Bangalore (IN); Sreehari Kumar Bhogineni, Bangalore (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 421 days.

(21) Appl. No.: 17/358,058

(22) Filed: Jun. 25, 2021

(65) Prior Publication Data

US 2022/0250886 A1 Aug. 11, 2022

(30) Foreign Application Priority Data

Feb. 11, 2021 (IN) ..... 202121005908

(51) Int. Cl.
*B66F 9/06* (2006.01)
*B66F 9/075* (2006.01)
*B66F 9/14* (2006.01)

(52) U.S. Cl.
CPC ..... *B66F 9/063* (2013.01); *B66F 9/0755* (2013.01); *B66F 9/07513* (2013.01); *B66F 9/143* (2013.01)

(58) Field of Classification Search
CPC .. B66F 9/12; B66F 9/122; B66F 9/143; B66F 9/142; B66F 9/144
See application file for complete search history.

(56) References Cited

U.S. PATENT DOCUMENTS 4,533,290 A * 8/1985 Hackauf ..... B66F 9/143 414/667
7,632,055 B2 * 12/2009 Foroni ..... B66F 9/142 414/667

(Continued)

FOREIGN PATENT DOCUMENTS

CN 111362190 A * 7/2020
CN 109399509 B 8/2020

(Continued)

OTHER PUBLICATIONS

Machine translation of CN 115215256.*

(Continued)

*Primary Examiner* — Diem M Tran
(74) *Attorney, Agent, or Firm* — Finnegan, Henderson, Farabow, Garrett & Dunner LLP

(57) ABSTRACT

Material handling of packed goods on pallets, roller cages within facilities is in huge volumes and consumes lot of operators' time and efforts. Embodiments of the present disclosure provide an autonomous payload handling apparatus (APHA) that addresses the above material handling process by automating with an intelligent modular robotic platform. The APHA includes fork assemblies that slides alongside of the pallet for better balance over payload and maintains smooth navigation. The fork assemblies equipped with contact/vision sensors that enable APHA to determine whether there is any offset or any contact between surfaces of APHA and/or pallet. The fork assemblies capture sensor data of surrounding object(s) during navigation, size of payload, and pallet, etc. The captured sensor data enables the APHA to correct its offset and/or compute a mode of approach (e.g., navigating angle, deviating from obstacle(s), sliding through pallet/roller cages, and the like) to handle payload(s).

16 Claims, 16 Drawing Sheets

(56) References Cited

U.S. PATENT DOCUMENTS

| | | | | |
|---|---|---|---|---|
| 9,221,658 | B2 * | 12/2015 | Matti | B66F 9/144 |
| 9,617,132 | B2 * | 4/2017 | Lotti | B66F 9/146 |
| 10,479,661 | B2 * | 11/2019 | King | B66F 9/143 |
| 2006/0181039 | A1 * | 8/2006 | Fridlington | B62B 3/0618 280/43.12 |
| 2010/0111647 | A1 * | 5/2010 | Noonan | B29C 49/04 414/24.5 |

FOREIGN PATENT DOCUMENTS

| | | | | |
|---|---|---|---|---|
| CN | 112811352 | A | * | 5/2021 |
| CN | 114057137 | A | * | 2/2022 |
| CN | 115215256 | A | * | 10/2022 |
| CN | 115231473 | A | * | 10/2022 |
| CN | 115367670 | A | * | 11/2022 |
| DE | 10 2013 201 818 | A1 | | 8/2014 |
| DE | 202016008511 | U1 | * | 6/2018 |
| EP | 0631975 | A1 | * | 6/1994 |
| KR | 20130128908 | A | * | 11/2013 |
| WO | WO 2014/122147 | A1 | | 8/2014 |

OTHER PUBLICATIONS

Lobo Allwyn M, "Design and Development of Mechanical Forklift," International Research Journal of Engineering and Technology (IRJET), 5(3):1125-1136 (2018).

Xiao et al., "Pallet recognition and localization using an RGB-D camera," International Journal of Advanced Robotic Systems, pp. 1-10 (2017).

* cited by examiner

AUTONOMOUS PAYLOAD HANDLING APPARATUS

PRIORITY CLAIM

This U.S. patent application claims priority under 35 U.S.C. § 119 to: India Application No. 202121005908, filed on Feb. 11, 2021. The entire contents of the aforementioned application are incorporated herein by reference.

TECHNICAL FIELD

The disclosure herein generally relates to payload handling apparatus, and, more particularly, to autonomous payload handling apparatus.

BACKGROUND

Pallet movements in any facilities such as warehouses, shopfloors, etc., are handled through manual fork jacks, forklift vehicles (manual driven, autonomous) and in some cases conveyors. In autonomous forklift vehicles there are various types such as counterbalance type, fork over type, etc. Fork over type robotic vehicles are more compact compared to counterbalance type of vehicles for various reasons. Some of the reasons include increase in footprint, turning radius, etc. Therefore, there is a need to address such reasons based on the facility layouts. Fork over autonomous robots are more in demand in the facilities/layouts where there is less room for any infrastructural change due to robotization. Due to this demand, there are lot of fork type autonomous guided vehicles (AGV)/or autonomous mobile robots (AMR) with different type of features available in market. However, the challenge remains in addressing multiple applications such as pallet movement, roller cage movements, custom pallet movements, etc. which can further address various payloads that need to be loaded onto or unloaded from a pallet from one location to another location.

SUMMARY

Embodiments of the present disclosure present technological improvements as solutions to one or more of the above-mentioned technical problems recognized by the inventors in conventional systems. In one aspect, there is provided an autonomous payload handling apparatus (APHA). The APHA comprises a chassis assembly comprising one or more friction pads, wherein each of the one or more friction pads is attached to at least one side of the chassis assembly; two or more fork assemblies coupled to the chassis assembly, wherein each of the two or more fork assemblies comprises a first end and a second end, wherein the second end of the two or more fork assemblies is coupled to a bottom end of the chassis assembly, wherein each of the two or more fork assemblies comprises a corresponding vertical fork plate, wherein the corresponding vertical fork plate comprises a first surface and a second surface, and wherein each of the two or more fork assemblies comprises a top plate and a bottom plate; a first long double left-hand (LH) right-hand (RH) lead screw mechanism and a second long double LH RH lead screw mechanism, wherein the first long double LH RH lead screw mechanism is accommodated within a first fork assembly of the two or more fork assemblies, and wherein the second long double LH RH lead screw mechanism is accommodated within a second fork assembly of the two or more fork assemblies. The APHA further comprises a cross-slide assembly mounted within the chassis assembly. The cross-slide assembly comprises a first linear shaft and a second linear shaft, wherein each of the first linear shaft and the second linear shaft comprises a first linear bearing block and a second bearing block, wherein the corresponding vertical fork plate of the two or more fork assemblies is coupled to the first linear bearing block and the second bearing block respectively via one or more screw mechanisms; a lead screw shaft positioned between the first linear shaft and the second linear shaft, wherein a first end and a second end of each of the first linear shaft, the second linear shaft, and the lead screw shaft are coupled to a first end and a second end of each of a first support block and a second support block, respectively.

In an embodiment, the autonomous payload handling apparatus is operated to enable the first end of the two or more fork assemblies to slide through a corresponding fork assembly receiver of a pallet.

In an embodiment, when the first end of the two or more fork assemblies navigates through a first end and a second end of the corresponding fork assembly receiver of the pallet, the first long double LH RH lead screw mechanism and the second long double LH RH lead screw mechanism are operated to (i) lift the top plate and (ii) enable at least one surface of the top plate to contact a bottom surface of the pallet.

In an embodiment, upon positioning the pallet on the top plate of each of the two or more fork assemblies the autonomous payload handling apparatus navigates to a desired location based on sensory information obtained from one or more sensors attached to the autonomous payload handling apparatus.

In an embodiment, each of the two or more fork assemblies comprises a plurality of plummer blocks, wherein a first plummer block of the plurality of plummer blocks is operatively connected to a first end of the first long double LH RH lead screw mechanism and the second long double LH RH lead screw mechanism respectively, wherein a second plummer block of the plurality of plummer blocks is operatively connected to a second end of the first long double LH RH lead screw mechanism and the second long double LH RH lead screw mechanism respectively, and wherein a third plummer block of the plurality of plummer blocks is operatively connected in the middle of the first long double LH RH lead screw mechanism and the second long double LH RH lead screw mechanism respectively to prevent the first long double LH RH lead screw mechanism and the second long double LH RH lead screw mechanism from buckling.

In an embodiment, each of the plurality of plummer blocks comprises a bearing unit. The bearing unit comprises one or more axial load bearings and/or one or more radial load bearings. The bearing unit is configured to convert vertical payload placed on the pallet as a radial payload.

In an embodiment, each of the first long double LH RH lead screw mechanism and the second long double LH RH lead screw mechanism is configured to convert rotation of a fork motor comprised in the two or more fork assemblies into a linear translation of a plurality of threaded blocks comprised therein.

In an embodiment, when each of the one or more threaded blocks is engaged with one or more linear bearings comprised therein, each of the one or more linear bearings is configured to slide and enable anti-rotation and linear motion of the plurality of threaded blocks.

In an embodiment, each of the plurality of threaded blocks comprises a protrusion, wherein the protrusion is configured to accommodate a plain bearing, and wherein the plain bearing is configured to reduce friction between (i) the protrusion, and (ii) one or more corresponding links mounted on the protrusion, and wherein a corresponding central pin is connected on an upper end of a corresponding link of the one or more corresponding links.

In an embodiment, an inward motion of the plurality of threaded blocks enables the corresponding central pin connected to the upper end of the corresponding link to move in an upward direction, wherein movement of the corresponding central pin in the upward direction causes the top plate of the two or more fork assemblies to move in a desired direction.

In an embodiment, length of the one or more corresponding links enables (i) an angular tilt of the top plate along with a vertical lift of the pallet with respect to the bottom plate, or (ii) lifting of a payload in parallel with the bottom plate of the two or more fork assemblies.

In an embodiment, wherein length of the one or more corresponding links prevents a dead lock of the two or more fork assemblies and reduces slackness thereof based on a pre-defined angle of the one or more corresponding links.

In an embodiment, the fork motor comprises a sensor feedback for controlled movement of the one or more corresponding links to lift a payload placed on the pallet.

In an embodiment, the autonomous payload handling apparatus further comprises a plurality of limit switches. Each of the plurality of limit switches is configured to control position of the two or more fork assemblies.

In an embodiment, the autonomous payload handling apparatus further comprises a plurality of spring-loaded bumpers. Each of the plurality of spring-loaded bumpers is connected to a corresponding bumper switch. The corresponding bumper switch is configured to enable navigation and locate the pallet or one or more objects during the navigation.

In an embodiment, the chassis assembly further comprises: a pair of spring-loaded wheels, each spring-loaded wheel from the pair of spring-loaded wheels is configured to (i) slide in a first direction and a second direction based on a predefined preload; an adjustable screw that is configured to (i) adjust height of the pair of spring-loaded wheels and (ii) move the pair of spring-loaded wheels in a specific direction. In an embodiment, the first direction is an upward direction, and the second direction is a downward direction.

In an embodiment, moving of the pair of spring-loaded wheels in the specific direction causes lifting of the autonomous payload handling apparatus such that the autonomous payload handling apparatus rests on a plurality of wheels.

In an embodiment, a first pair of threaded blocks from the plurality of threaded blocks is positioned at a first end of each of the first long double LH RH lead screw mechanism and the second long double LH RH lead screw mechanism. In another embodiment, a second pair of threaded blocks from the plurality of threaded blocks is positioned at a second end of each of the first long double LH RH lead screw mechanism and the second long double LH RH lead screw mechanism.

In an embodiment, each of the first long double LH RH lead screw mechanism and the second long double LH RH lead screw mechanism comprises another lead screw shaft with a first thread, a second thread, a third thread, and a fourth thread.

In an embodiment, the first thread, and the fourth thread have an outer diameter that is less than an inner diameter of one or more threaded blocks mounted on the second thread and the third thread.

In an embodiment, the corresponding bumper switch is mounted at the first end of the two or more fork assemblies.

In an embodiment, when the two or more fork assemblies slide through the corresponding fork assembly receiver of the pallet, the corresponding bumper switch (138A-N) (i) determine whether is an offset between the two or more fork assemblies and the corresponding fork assembly receiver of the pallet, (ii) calculate a navigating angle based on the offset, and (iii) enable the autonomous payload handling apparatus to correct the offset based on the navigating angle and slide through the corresponding fork assembly receiver of the pallet and further reduce frictional contact between the two or more fork assemblies and the pallet.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Figure 1A:
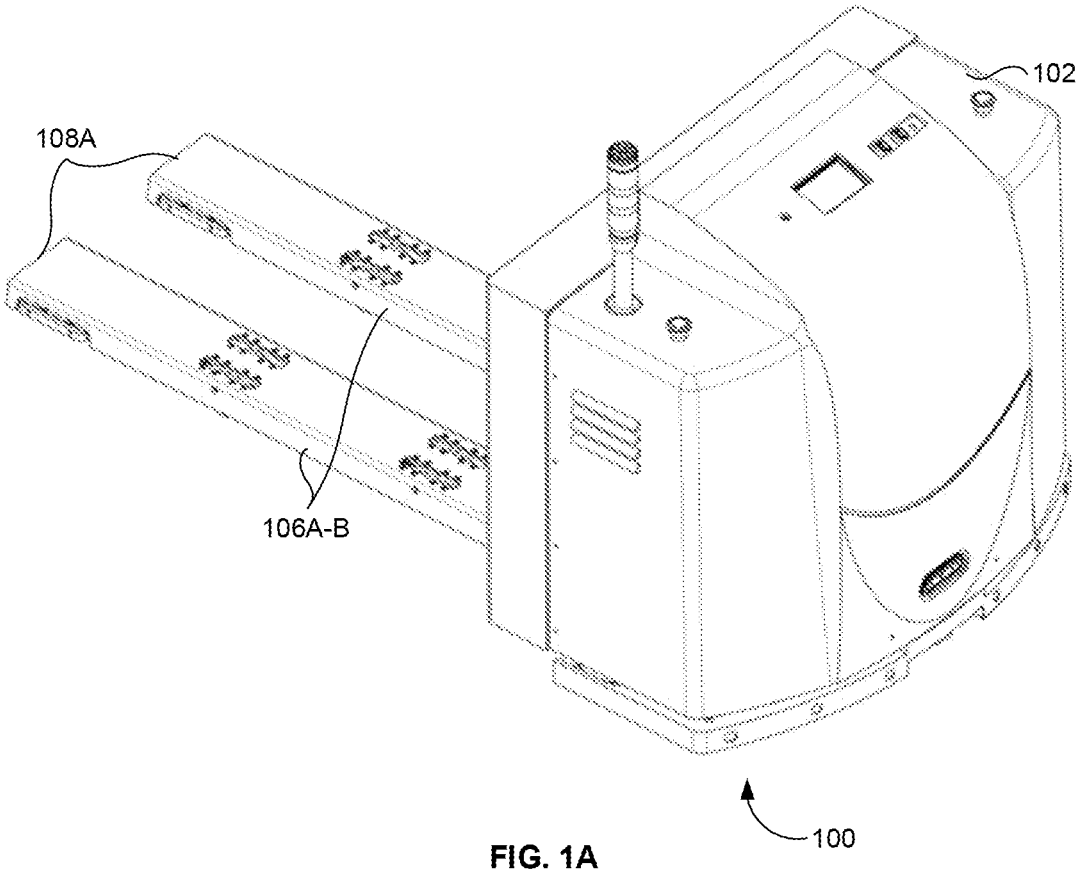
FIGS. 1A and 1B depict a perspective view of an autonomous payload handling apparatus (APHA), in accordance with an embodiment of the present disclosure.

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

There is huge demand for automation in manufacturing, logistics, postal, distribution centers, ecommerce, retail, etc. Material handling of packed goods on pallets, roller cages within facilities is in huge volumes and consumes lot of operators' time and efforts (e.g., work in some cases 24/7 in multiple shifts). Embodiments of the present disclosure provide an autonomous payload handling apparatus (APHA) that addresses the above material handling process by automating with an intelligent modular robotic platform which can carry payloads and can be controlled via cloud/local fleet management system(s). In other words, the APHA 100 can be connected to a device such as an edge device or an edge computer or a cloud via communication interfaces (e.g., Wi-Fi interfaces through secured and encrypted techniques) for control and navigation. More specifically, embodiments of the present disclosure provide a modular platform such as the APHA which addresses wide variety of payloads like pallets, roll cages, etc. Typically, payloads vary in dimensions in various applications, and they may be placed on various objects/floor or on a raised platform. Embodiments of the present disclosure provide the APHA that is configured to handle multiple payload variants, for example, pallets for varying sizes such as Euro pallets, US pallets, and varying dimensions. Each such pallet may house varying size of payload(s). The APHA as described by the present disclosure includes fork assemblies that slides on the width side of the pallet to get better balance over the payload and also maintain the navigation smooth. The fork assemblies are further equipped with contact and vision sensors that enable the APHA to determine whether there is any offset or any contact between surfaces of the APHA and the pallet. With the help of vision sensors, the fork assemblies capture image data (or sensor data) of object(s) (e.g., surrounding object(s) during navigation, size of payload, and pallet, etc.). Such sensor data can be in the form of 2-dimensional (2D) sensor data and/or 3-dimensional (3D) sensor data that is captured from a distance. The captured sensor data enables the APHA to correct its offset and/or compute a mode of approach to handle the payload. The mode of approach, for instance, shall include, navigating angle, sliding through pallet/roller cages, and the like.

Referring now to the drawings, and more particularly to FIG. 1 through 10B, where similar reference characters denote corresponding features consistently throughout the figures, there are shown preferred embodiments and these embodiments are described in the context of the following exemplary system and/or method.

Reference numerals of one or more components of the autonomous payload handling apparatus as depicted in the FIGS. 1A through 10B are provided in Table 1 below for ease of description:

TABLE 1

| SI. No | Component | Numeral reference |
|---|---|---|
| 1 | Autonomous payload handling apparatus (APHA) | 100 |
| 2 | Chassis assembly | 102 |
| 3 | A plurality of friction pads | 104A-N |
| 4 | Two or more fork assemblies | 106A-B |
| 5 | First end and second end of the two or more fork assemblies | 108A-B |
| 6 | Vertical fork plates | 110A-B |
| 7 | First surface and a second surface of the vertical fork plates | 112A-B |
| 8 | Top plate | 114A |
| 9 | Bottom plate | 114B |
| 10 | First long double left-hand (LH) right-hand (RH) lead screw mechanism | 116A |
| 11 | Second long double LH RH lead screw mechanism | 116B |
| 12 | A plurality of plummer blocks | 118A-C |
| 13 | First end, second end and mid-region | 120A-C |
| 14 | Bearing unit | 122 |
| 15 | A plurality of threaded blocks | 124A-N |
| 16 | Fork motor | 126 |
| 17 | One or more linear bearings | 128A-N |
| 18 | One or more corresponding links | 130A-N |
| 19 | A plurality of central pins | 132A-N |
| 20 | One or more limit switches | 134A-N |
| 21 | A plurality of spring-loaded bumpers | 136A-N |
| 22 | A plurality of bumper switches | 138A-N |
| 23 | Cross-slide assembly | 140 |
| 24 | First linear shaft and a second linear shaft | 142A-B |

TABLE 1-continued

| SI. No | Component | Numeral reference |
|---|---|---|
| 25 | A first linear bearing block and a second linear bearing block | 144A-B |
| 26 | Lead screw shaft | 146 |
| 27 | A first support block and a second support block | 148A-B |
| 28 | A follower gear | 150 |
| 29 | A pair of spring-loaded wheels | 152A-B |
| 30 | An adjustable screw | 154 |
| 31 | Lead screw shaft | 156 |
| 32 | First thread, second thread, third thread and fourth thread | 158A-D |
| 33 | One or more vision sensors | 160A-N |

Figure 1B:
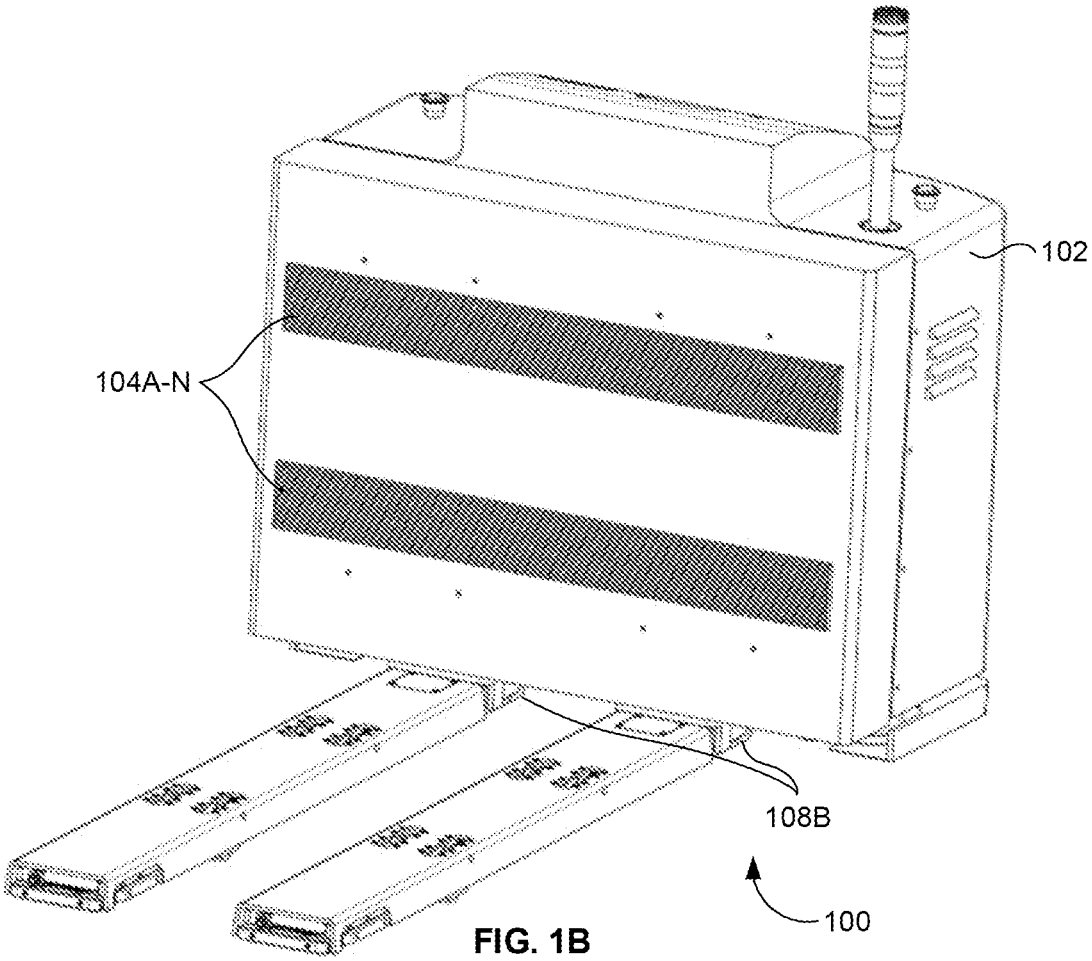
Figure 1C:
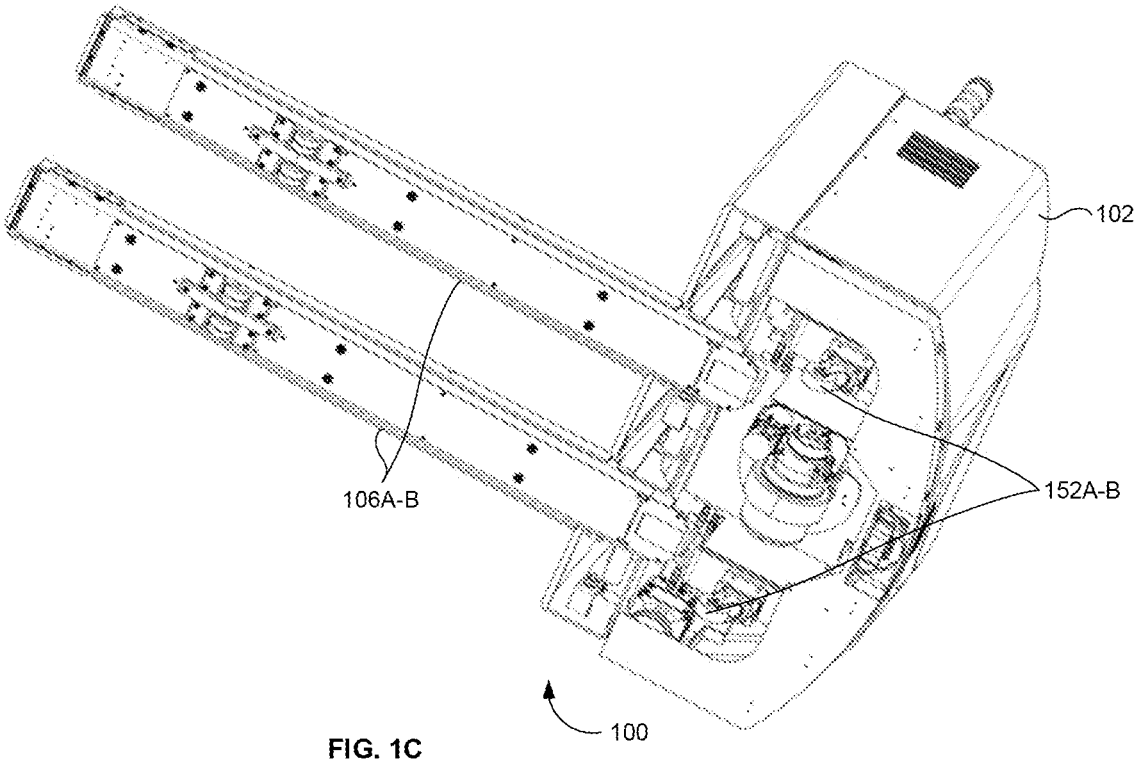
FIG. 1C depicts a bottom perspective view of the APHA, in accordance with an embodiment of the present disclosure.
Figure 5A:
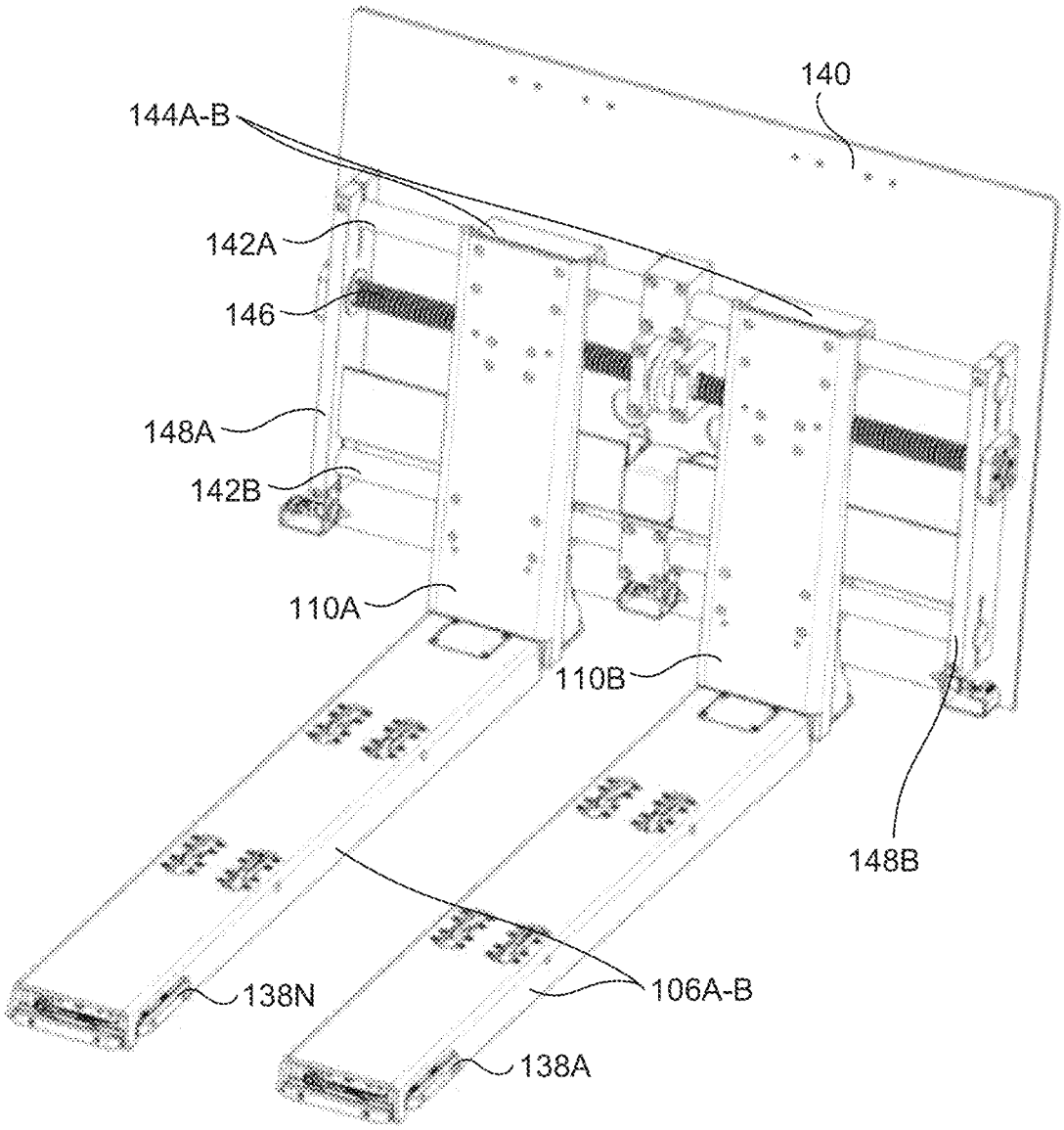
FIG. 5A depicts a perspective view of the fork assemblies operatively coupled/connected to the cross-slide assembly, in accordance with an embodiment of the present disclosure.

FIGS. 1A and 1B depict a perspective view of an autonomous payload handling apparatus (APHA) 100, in accordance with an embodiment of the present disclosure. The APHA comprises a chassis assembly 102 comprising one or more friction pads 104A-N, two or more fork assemblies 106A-B coupled to the chassis assembly 102. The one or more friction pads 104A-N provide friction to the payload during loading and unloading of the payload from one location to another location thus preventing the payload from any slippage. Each of the two or more fork assemblies 106A-B comprises a first end 108A and a second end 108B. The two or more fork assemblies 106A-B may be referred as fork assemblies 106A-B/106 (or collectively as fork assembly 106) and interchangeable used herein. While the first end 108A of the two or more fork assemblies 106A-B have one or more vision sensors and/or one or more corresponding bumper switches mounted thereon, the second end 108B of the two or more fork assemblies 106A-B is coupled to a bottom end of the chassis assembly 102. For instance, connection (or coupling) of the second end 108B to the bottom end of the chassis assembly 102 is depicted in FIG. 1C. More specifically, FIG. 1C depicts a bottom perspective view of the APHA 100, in accordance with an embodiment of the present disclosure. It is to be understood by a person having ordinary skill in the art or person skilled in the art that though FIG. 1C depicts other components of the APHA 100, FIG. 1C is referenced to show coupling of the second end 108B of the fork assemblies 106A-B to the chassis assembly 102 and such example shall not be construed as limiting the scope of the present disclosure. Further, each of the two or more fork assemblies 106A-B comprises a corresponding vertical fork plate (e.g., vertical fork plate 110A-B as depicted in FIG. 5A). The corresponding vertical fork plate comprises a first surface 112A and a second surface 112B. Each of the two or more fork assemblies 106A-B comprises a top plate 114A and a bottom plate 114B.

Figure 2A:
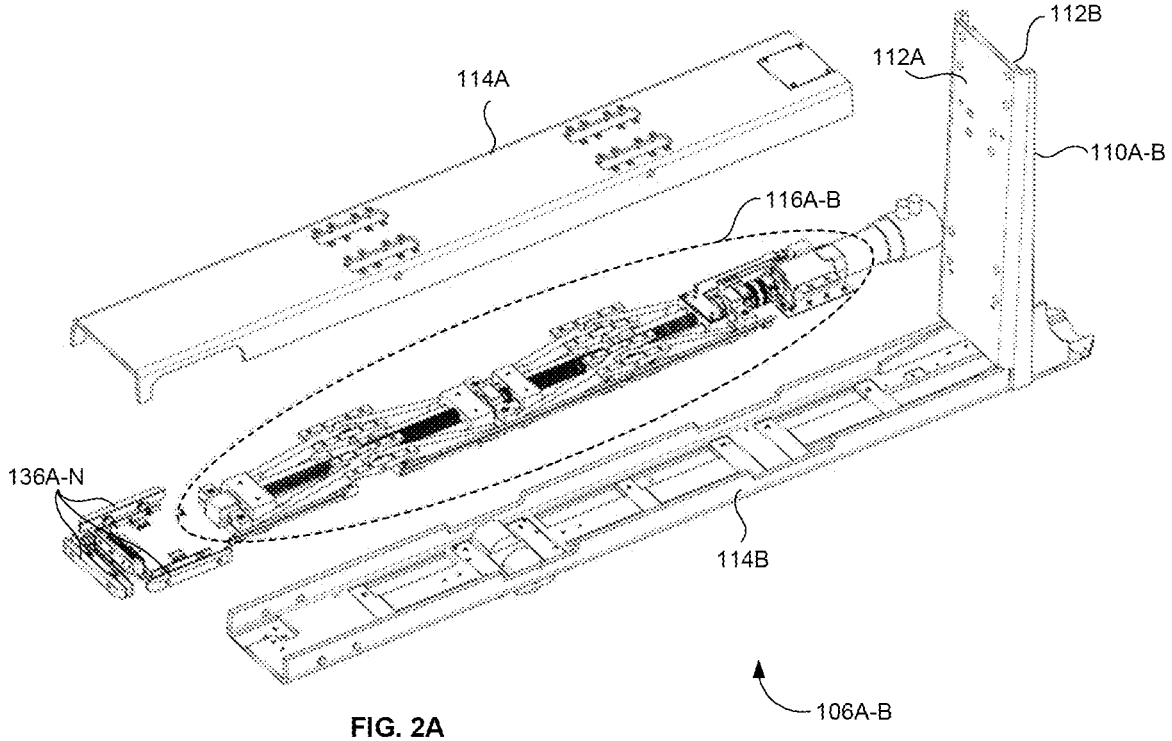
FIG. 2A depicts an exploded view of a fork assembly illustrating a long double left-hand (LH) right-hand (RH) lead screw mechanism comprised in the APHA therein, in accordance with an embodiment of the present disclosure.
Figure 2B:
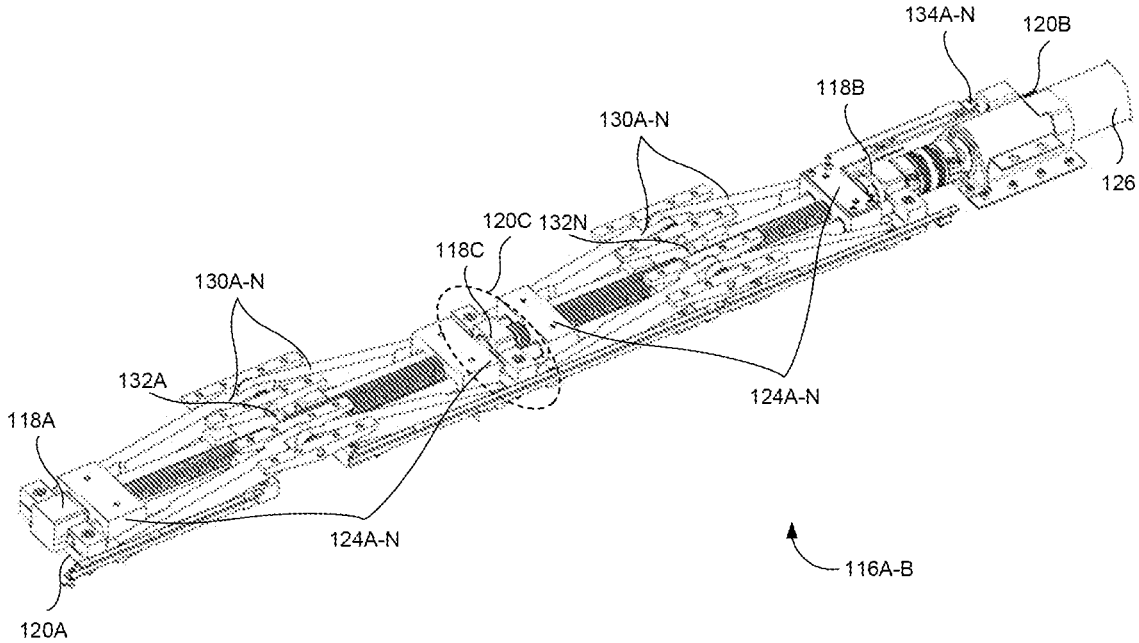
FIG. 2B depicts a perspective view of the long double LH RH lead screw mechanism comprised in the fork assembly of the APHA, in accordance with an embodiment of the present disclosure.
Figure 3A:
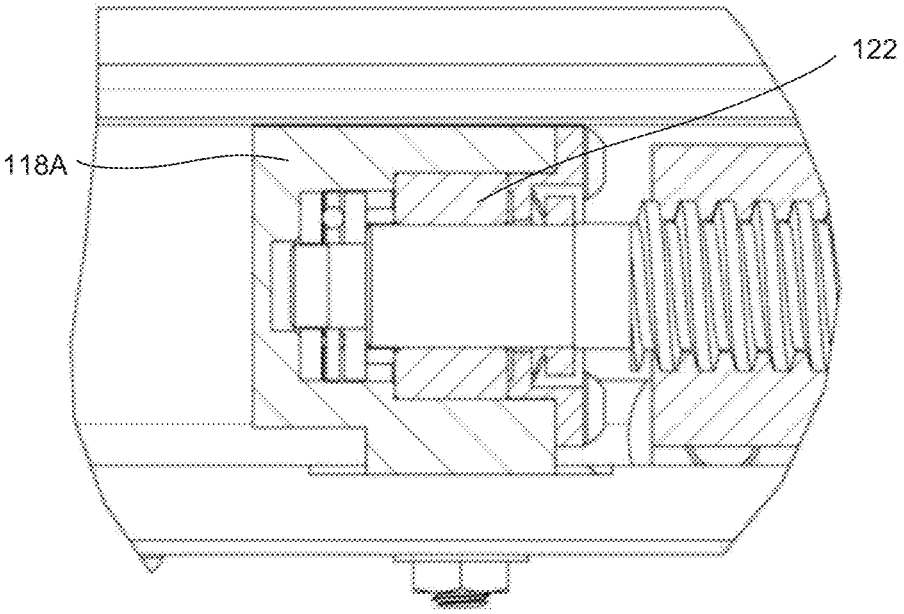
FIG. 3A depicts a first end of a first long double LH RH lead screw mechanism and a second long double LH RH lead screw mechanism, respectively illustrating a bearing unit, in accordance with an embodiment of the present disclosure.
Figure 3B:
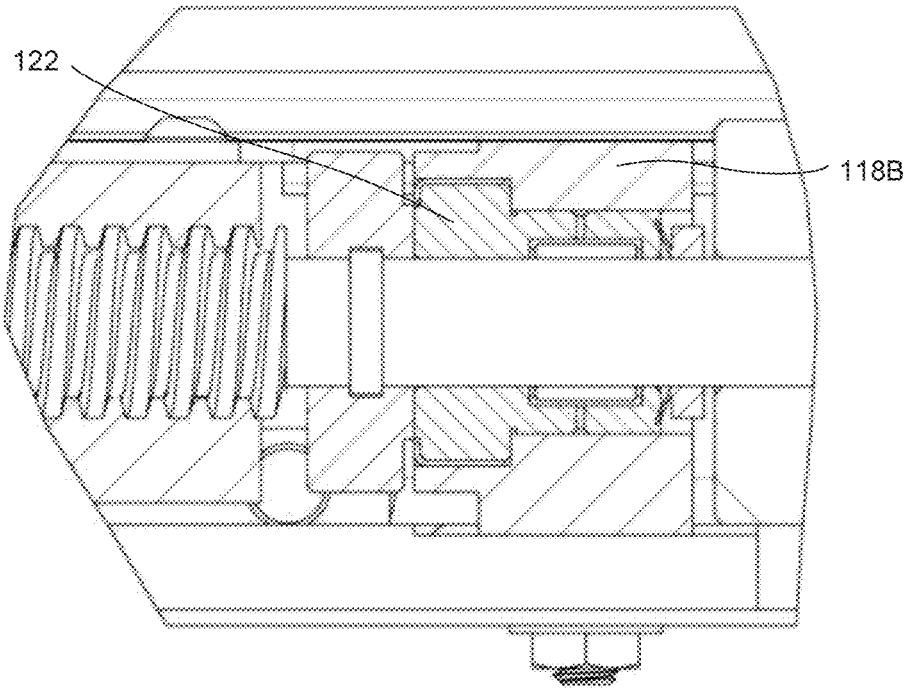
FIG. 3B depicts a second end of the first long double LH RH lead screw mechanism and the second long double LH RH lead screw mechanism respectively illustrating the bearing unit, in accordance with an embodiment of the present disclosure.
Figure 3C:
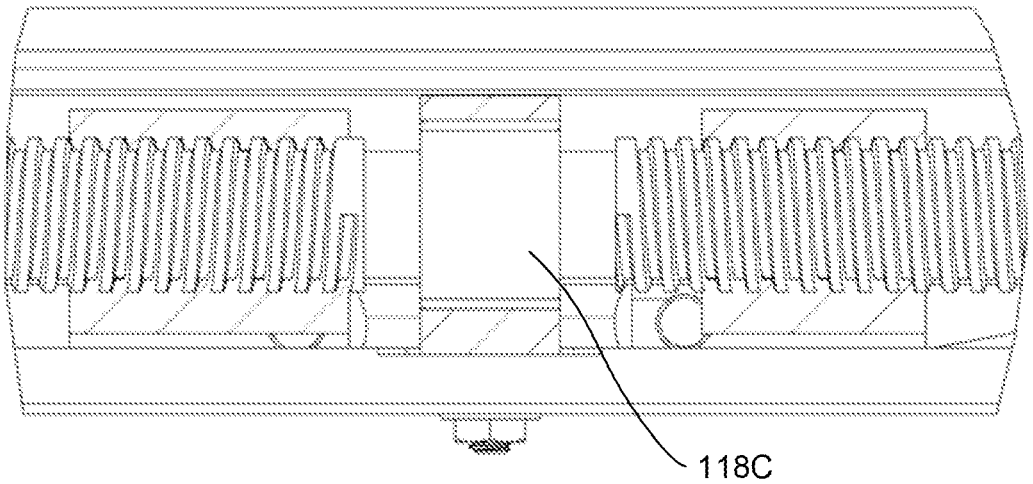
FIG. 3C depicts a mid-region of the first long double LH RH lead screw mechanism and the second long double LH RH lead screw mechanism respectively illustrating the bearing unit, in accordance with an embodiment of the present disclosure.

The APHA 100 further comprise a first long double left-hand (LH) right-hand (RH) lead screw mechanism 116A and a second long double left-hand (LH) right-hand (RH) lead screw mechanism 116B. The expressions 'first long double left-hand right-hand lead screw mechanism' and 'second long double left-hand right-hand lead screw mechanism 116B' may also be referred as 'first long double LH RH lead screw mechanism' and 'second long double LH RH lead screw mechanism' and interchangeably used herein. The first long double LH RH lead screw mechanism 116A is accommodated/comprised within a first fork assembly 106A of the two or more fork assemblies 106A-B, and the second long double LH RH lead screw mechanism 116B is accommodated/comprised within a second fork assembly 106B of the two or more fork assemblies 106A-B. FIG. 2A, with reference to FIGS. 1A through 1C, depicts an exploded view of a fork assembly illustrating a long double LH RH lead screw mechanism comprised in the APHA therein, in accordance with an embodiment of the present disclosure. FIG. 2B, with reference to FIGS. 1A through 2A, depicts a perspective view of the long double LH RH lead screw mechanism comprised in the fork assembly of the APHA 100, in accordance with an embodiment of the present disclosure. Each of the each of the two or more fork assemblies 106A-B comprises a plurality of plummer blocks 118A-C (also referred as 118A-N). A first plummer block 118A of the plurality of plummer blocks 118A-C is operatively connected to a first end 120A of the first long double LH RH lead screw mechanism 116A and the second long double LH RH lead screw mechanism 116B respectively. The second plummer block 118B of the plurality of plummer blocks 118A-C is operatively connected to a second end 120B of the first long double LH RH lead screw mechanism 116A and the second long double LH RH lead screw mechanism 116B respectively. A third plummer block 118N of the plurality of plummer blocks 118A-C is operatively connected in the middle (mid-region 120C) of the first long double LH RH lead screw mechanism 116A and the second long double LH RH lead screw mechanism 116B respectively to prevent the first long double LH RH lead screw mechanism 116A and the second long double LH RH lead screw mechanism 116B from buckling. The three plummer blocks supported at the above three points prevent a shaft comprised in the first long double LH RH lead screw mechanism 116A and the second long double LH RH lead screw mechanism from bending. Each of the plurality of plummer blocks 118A-N comprises a bearing unit 122. The bearing unit 122 is of one or more axial load bearings type and/or one or more radial load bearings type. The radial load bearing type is any of ball bearing, a roller bearing, a needle bearing, a plain bearing, or any other load bearing which takes only radial load. The combination of axial and radial load carrying bearings could be angular contact bearings, a combination of thrust and needle/ball bearing, etc. The bearing unit 122 is configured to take the axial load that is one of the components of forces due to the placement of the vertical payload placed on the pallet. The vertical payload gets split into two components of forces as it gets transferred through the threaded blocks. One is the axial component and radial component. The radial component gets transferred through the linear bearings of the plurality of threaded blocks 124A-N and then to the plurality of plummer blocks 118A-N. The axial component of the vertical payload gets transferred through the threads of the first and second long double LH RH lead screw mechanisms 116A-B. This axial component force is finally transferred through the axial load bearing present in the bearing unit 122. Radial bearing present in the bearing unit 122 also supports the first and second long double LH RH lead screw mechanisms 116A-B for (a small/minimal) amount of radial load and maximum amount for axial loads. FIG. 3A, with reference to FIGS. 1A through 2B, depicts the first end 120A of the first long double LH RH lead screw mechanism 116A and the second long double LH RH lead screw mechanism 116B, respectively illustrating the bearing unit 122, in accordance with an embodiment of the present disclosure. FIG. 3B, with reference to FIGS. 1A through 3A, depicts the second end 120B of the first long double LH RH lead screw mechanism 116A and the second long double LH RH lead screw mechanism 116B respectively illustrating the bearing unit 122, in accordance with an embodiment of the present disclosure. FIG. 3C, with reference to FIGS. 1A through 3B, depicts the mid-region 120C of the first long double LH RH lead screw mechanism 116A and the second long double LH RH lead screw mechanism 116B respectively illustrating the bearing unit 122, in accordance with an embodiment of the present disclosure. Each of the first long double LH RH lead screw mechanism 116A and the second long double LH RH lead screw mechanism 116B further comprise a plurality of threaded blocks 124A-N as depicted in FIG. 2B and FIGS. 3A through 3C. More specifically, a first pair of threaded blocks from the plurality of threaded blocks 124A-N are positioned at a first end of each of the first long double LH RH lead screw mechanism 116A and the second long double LH RH lead screw mechanism 116B, and a second pair of threaded blocks from the plurality of threaded blocks 124A-N are positioned at a second end of each of the first long double LH RH lead screw mechanism 116A and the second long double LH RH lead screw mechanism 116B respectively. Each of the first long double LH RH lead screw mechanism 116A and the second long double LH RH lead screw mechanism 116B comprises a lead screw shaft 156 with a first thread 158A, a second thread 158B, a third thread 158C, and a fourth thread 158D (refer FIG. 9A). FIG. 9A depicts a portion of each of the first long double LH RH lead screw mechanism 116A and the second long double LH RH lead screw mechanism 116B illustrating the lead screw shaft 156, the plurality of threaded blocks 124A-N, with the first thread 158A, the second thread 158B, the third thread 158C and the fourth thread 158D, in accordance with an embodiment of the present disclosure. FIG. 9B, with reference to FIGS. 1A through 9A, depicts a cross sectional view of the lead screw shaft 156 with the plurality of threaded blocks 124A-N comprised in each of the first long double LH RH lead screw mechanism 116A and the second long double LH RH lead screw mechanism 116B, in accordance with an embodiment of the present disclosure. FIG. 9C, with reference to FIGS. 1A through 9B, depicts a cross sectional view of the lead screw shaft 156, in accordance with an embodiment of the present disclosure.

Figure 7:
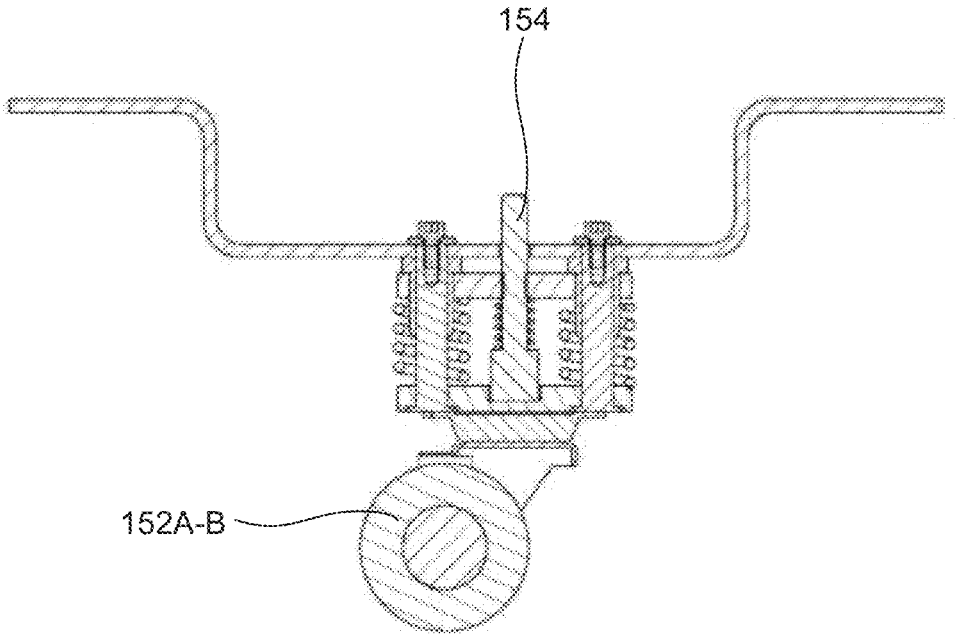
FIG. 7 depicts a sectional view of the adjustable screw and a pair of spring-loaded wheels comprised in the APHA, in accordance with an embodiment of the present disclosure.
Figure 8:
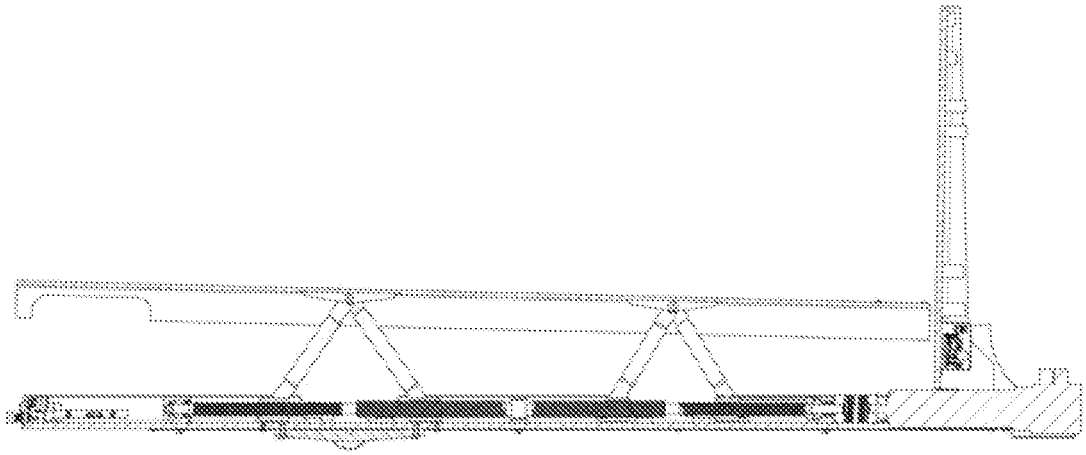
FIG. 8 depicts a sectional view of the fork assemblies in a lifted position, in accordance with an embodiment of the present disclosure.
Figure 9A:
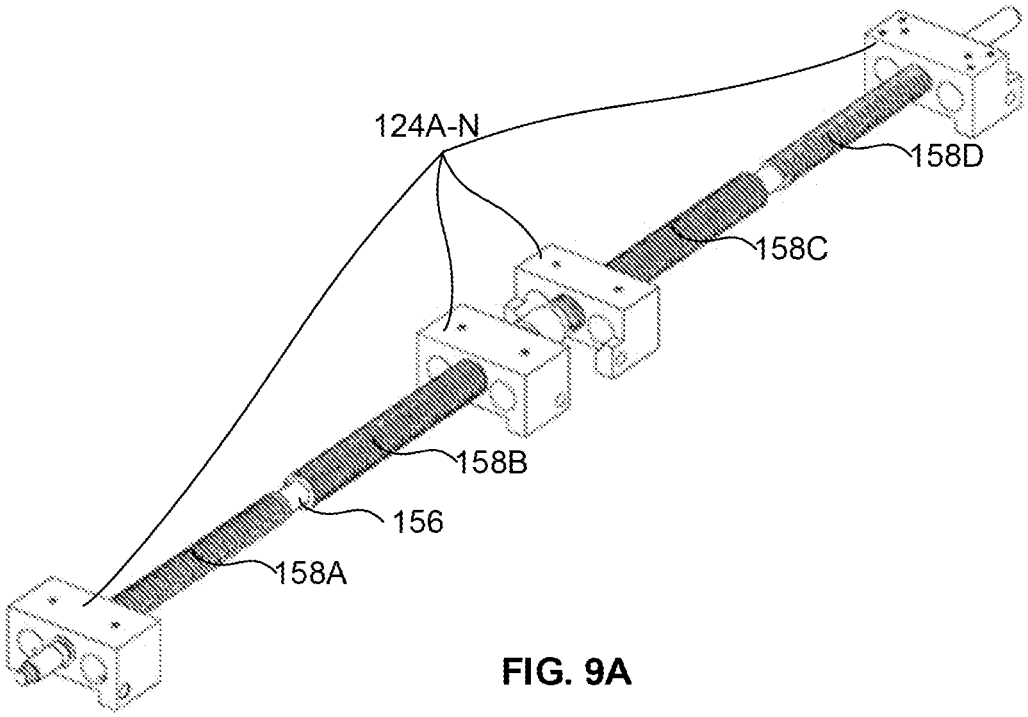
FIG. 9A depicts a portion of each of the first long double LH RH lead screw mechanism and the second long double LH RH lead screw mechanism illustrating a lead screw shaft, a plurality of threaded blocks, with a first thread, a second thread, a third thread, and the fourth thread, in accordance with an embodiment of the present disclosure.
Figure 9B:
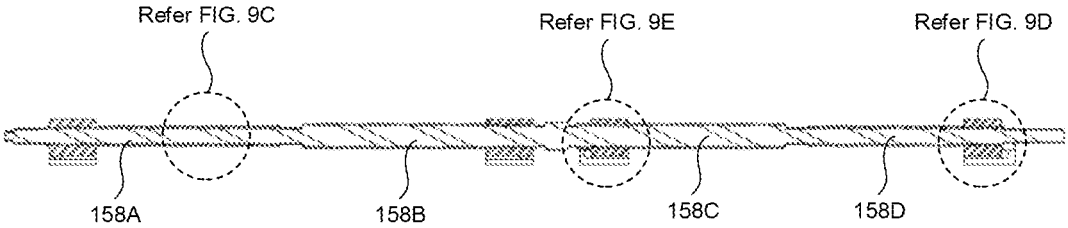
FIG. 9B depicts a cross sectional view of the lead screw shaft with the plurality of threaded blocks comprised in each of the first long double LH RH lead screw mechanism and the second long double LH RH lead screw mechanism, in accordance with an embodiment of the present disclosure.
Figure 9C:
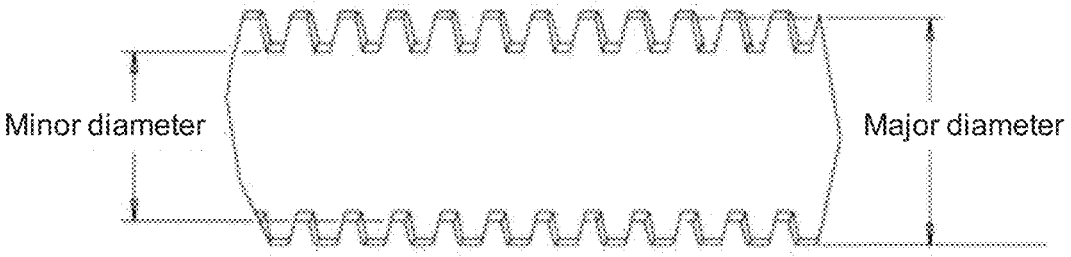
FIG. 9C depicts a cross sectional view of the lead screw shaft, in accordance with an embodiment of the present disclosure.
Figure 9D:
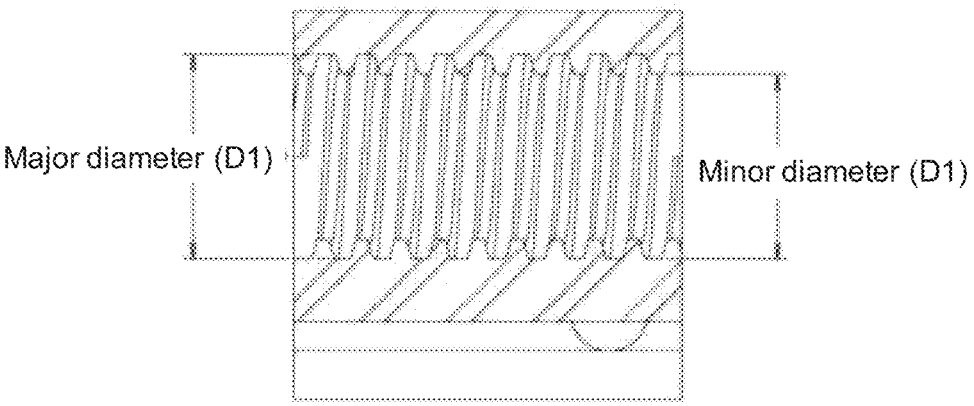
FIG. 9D depicts a cross sectional view of a threaded block comprised at the end of each of the first long double LH RH lead screw mechanism and the second long double LH RH lead screw mechanism, in accordance with an embodiment of the present disclosure.
Figure 9E:
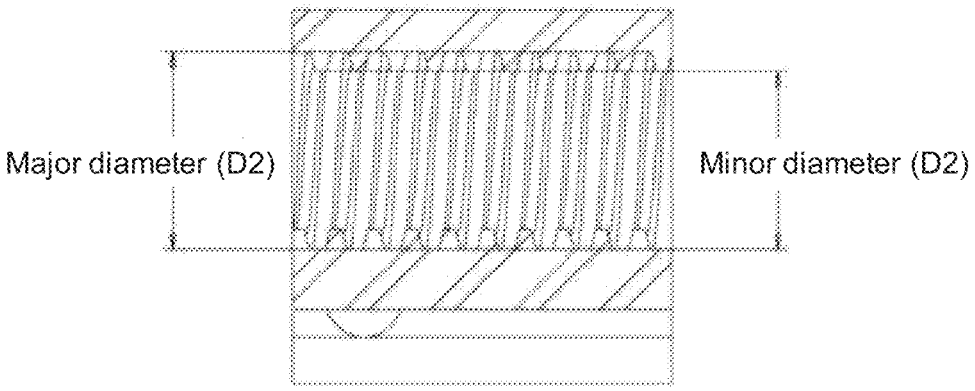
FIG. 9E depicts a cross sectional view of a threaded block comprised at mid-region of each of the first long double LH RH lead screw mechanism and the second long double LH RH lead screw mechanism, in accordance with an embodiment of the present disclosure.

FIG. 9D, with reference to FIGS. 1A through 9C, depicts a cross sectional view of a threaded block comprised at the end of each of the first long double LH RH lead screw mechanism 116A and the second long double LH RH lead screw mechanism 116B, in accordance with an embodiment of the present disclosure. FIG. 9E, with reference to FIGS. 1A through 9D, depicts a cross sectional view of a threaded block comprised at mid-region of each of the first long double LH RH lead screw mechanism 116A and the second long double LH RH lead screw mechanism 116B, in accordance with an embodiment of the present disclosure. As depicted in FIGS. 9A through 9E, the first thread, and the fourth thread have an outer diameter (e.g., also referred as major diameter, bigger diameter and interchangeably used herein) that is less than an inner diameter (e.g., also referred as minor diameter, smaller diameter, and interchangeably used herein) of one or more thread blocks mounted on the second thread and the third thread. Such diameter combinations enable easy assembling of the threaded blocks to the bigger threads since the major diameter of smaller thread is smaller than minor diameter of the threaded blocks.

Of the four threads, 2 threads closer to the first end of the first long double LH RH lead screw mechanism 116A and the second long double LH RH lead screw mechanism 116B form a first set and 2 threads closer to the second end of the first long double LH RH lead screw mechanism 116A and the second long double LH RH lead screw mechanism 116B form a second set. Such combination or formation of thread operate (or enable operation of) different set of links (e.g., 2 different set of links) to attain two different levels in the top plate 114A at two different points (e.g., refer FIGS. 3A through 3C).

Other combinations include scenarios wherein bigger and smaller thread combinations are present such that one combination can be (i) bigger threads are left hand threads where smaller threads are right hand threads and (ii) bigger threads can be right hand threads where smaller threads are left hand threads. It is to be understood by a person having ordinary skill in the art or person skilled in the art that FIGS. depict one type of thread, and such unique combination of the four threads satisfying the above can be chosen to be either square thread, acme thread or any other standard thread type based on the axial force, pitch, and other requirements. Examples of such threading shall not be construed as limiting the scope of the present disclosure. Further, the four threads can be of same pitch or may vary based on the requirements. The four threads individually screwed with the plurality of the threaded blocks such that the fork motor rotation in one direction causes the plurality of threaded blocks to move linearly towards a corresponding thread relief step and the fork motor rotation in other direction causes the plurality of threaded blocks to move linearly towards and away from the thread relief step.

Figure 4A:
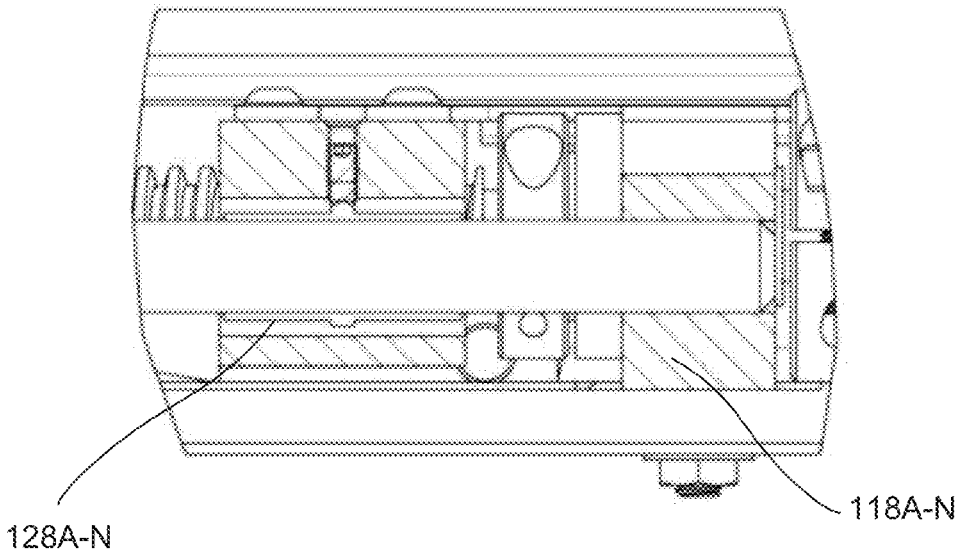
FIGS. 4A and 4B depict a portion of the first long double LH RH lead screw mechanism and the second long double LH RH lead screw mechanism illustrating one or more linear bearings, in accordance with an embodiment of the present disclosure.
Figure 4B:
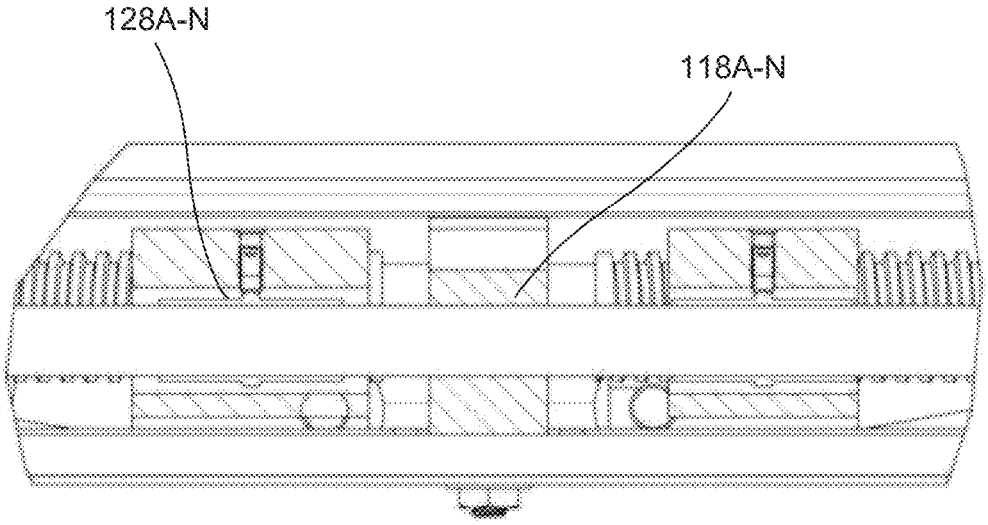

Each of the first long double LH RH lead screw mechanism 116A and the second long double LH RH lead screw mechanism 116B is configured to convert rotation of a fork motor 126 comprised in the two or more fork assemblies 106A-B (or fork motor 126 comprised in each of the two or more fork assemblies 106A-B) into a linear translation of the plurality of threaded blocks 124A-N comprised therein. Each of the first long double LH RH lead screw mechanism 116A and the second long double LH RH lead screw mechanism 116B further comprises one or more linear bearings 128A-N (also referred as linear bearings or collectively referred as linear bearing). FIGS. 4A and 4B, with reference to FIGS. 1A through 3C, depict a portion of the first long double LH RH lead screw mechanism 116A and the second long double LH RH lead screw mechanism 116B illustrating the one or more linear bearings 128A-N, in accordance with an embodiment of the present disclosure. When each of the one or more threaded blocks 124A-N engage with the linear bearings 128A-N, each of the linear bearings 128A-N slide and enable anti-rotation and linear motion of each of the plurality of threaded blocks 124A-N.

Each of the plurality of threaded blocks 124A-N comprises a protrusion (not shown in FIGS.). The protrusion (or corresponding protrusion) is configured to accommodate a plain bearing (not shown in FIGS.). One or more links 130A-N (refer FIG. 2B) are mounted on the protrusion. The one or more links are also referred as one or more corresponding links and interchangeably used herein. The plain bearing is configured to reduce friction between (i) the one or more corresponding links mounted on the protrusion and (ii) the protrusion. Each of the first long double LH RH lead screw mechanism 116A and the second long double LH RH lead screw mechanism 116B further comprises a plurality of central pins 132A-N (e.g., collectively referred as central pin). Each corresponding central pin of the plurality of central pins 132A-N is connected on an upper end of a corresponding link of the one or more corresponding links 130A-N. For instance, the central pin say 132A is connected to an upper end of the link 130A. Each of the links 130A-N has an inner side and an outer side. The inner side of the links 130A-N face towards a direction of the first and the second long double LH RH lead screw mechanisms 116A-B, and the outer side of the links 130A-N face in an opposite direction of the first and the second long double LH RH lead screw mechanisms 116A-B.

An inward motion of each of the one or more threaded blocks 124A-N enables the corresponding central pin (e.g., say central pin 132A) connected to the upper end of the corresponding link (e.g., link 130A) to move in an upward direction. Such movement of the corresponding central pin in the upward direction causes the top plate 114A of the two or more fork assemblies 106A-B to move in a desired direction (e.g., upward direction). The length of the one or more corresponding links 130A-N enable (i) an angular tilt of the top plate 114A along with a vertical lift of the pallet with respect to the bottom plate 114B, or (ii) lifting of a payload in parallel with the bottom plate 114B of the two or more fork assemblies 106A-B. Further, the length of the one or more corresponding links 130A-N is such that the links 130A-N prevents a dead lock of the two or more fork assemblies 106A-B and reduce slackness thereof based on a pre-defined angle of the one or more corresponding links 130A-N. In an embodiment of the present disclosure, length of each of the links 130A-N make a starting minimum angle closer to 10 degree (e.g., the pre-defined angle) with horizontal which is ensured by a limit switch and as an extra safety by a lower limiter to reduce slackness thus ensuring there is no dead lock. The length of these links 130A-N can vary according to the design requirements. Such variation in the links length shall not be construed as limiting the scope of the present disclosure. For instance, in a first scenario, in the present disclosure, it was observed through experiments that length of four links at the first end of the first long double LH RH lead screw mechanism 116A and the second long double LH RH lead screw mechanism 116B were chosen to be slightly smaller than the length of four links at the second end of first long double LH RH lead screw mechanism 116A and the second long double LH RH lead screw mechanism 116B. Such arrangement caused the lift at the first end to be smaller than the vertical lift at second end which led to a small angular tilt of the top plate 114A along with the vertical lift for specific applications. In a second scenario of the present disclosure wherein length of all the links 130A-N was chosen to be equal. In such scenario, it was observed through experiments that lifting height at the first end and the second end of the first long double LH RH lead screw mechanism 116A and the second long double LH RH lead screw mechanism 116B was the same thus causing the top plate 114A to lift parallel with the bottom plate 114B which may be version of product for another specific application(s). The APHA 100 was provisioned with a sensor feedback for controlled movement of the links. More specifically, in the present disclosure, the fork motor 126 received the sensor feedback (via one or more sensors mounted on (or internally connected to) the APHA 100 for controlled movement of the one or more corresponding links 130A-N to lift a payload placed on the pallet. A fork motor cover is mounted integral with the bottom side of the bottom plate 114B to protect the fork motor 126 from accidentally touching the ground surface or bumps in ground. Each of the two or more fork assemblies further comprises one or more limit switches 134A-N (or collectively referred as limit switch 134 and interchangeably used herein). The one or more limit switches 134A-N control position of the two or more fork assemblies 106A-B. The limits switches 134A-N are mounted on the APHA 100 to restrict extreme movements well within a limit and prevent from going to (i) a lower limit on a lower most position of the fork assemblies 106A-B and (ii) an upper limit to upper most position of the fork assemblies 106A-B. The limit switches 134A-N are enabled with help of a corresponding limit switch bracket mounted on respective threaded block(s). The limit switch bracket contacts with each of the limit switch depending on its two extreme positions. If the fork assemblies 106A-B need to be stopped at any other intermediate lifted positions depending on the height of the payload and its type, then such stopping of fork assemblies 106A-B is achieved by rotating the fork motor 126 to corresponding number of revolutions and this is controlled by rotary encoder (or sensor) feedback of the fork motor 126. The limit switches ensure safe operations to restrict at one of extreme collapsed or expanded conditions.

Figure 5B:
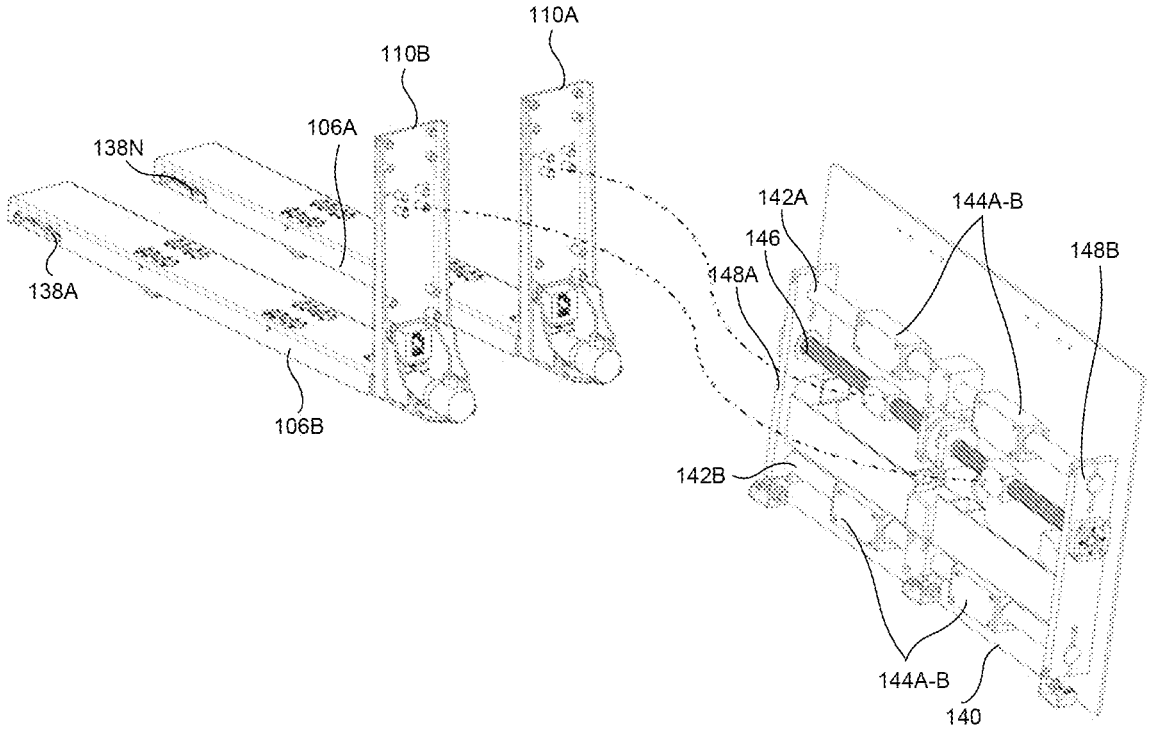
FIG. 5B depicts a view illustrating connectivity between the fork assemblies and the cross-slide assembly, in accordance with an embodiment of the present disclosure.

Though the position of the limit switch is depicted near the fork motor 126 as depicted in FIG. 2B, it is to be understood by a person having ordinary skill in the art or person skilled in the art that the position of the limit switch can be anywhere around the APHA or within the APHA 100 and such positioning of the limit switch as depicted in FIG. 2B shall not be construed as limiting the scope of the present disclosure. Each of the two or more fork assemblies 106A-B comprises one or more spring-loaded bumpers (e.g., also referred as a plurality of spring-loaded bumpers) 136A-N. The plurality of spring-loaded bumpers 136A-N are connected to a plurality of bumper switches 138A-N. For instance, a spring-loaded bumpers 136A is connected to a corresponding bumper switch 138A as depicted in FIG. 5B. Each of the plurality of bumper switches 138A-N enables navigation and locating of the pallet or one or more objects during the navigation When the fork assemblies 106A-B are entering the openings of the pallet or the payload due to actual locations of the APHA 100 there could be a chance that the front face of the fork assemblies 106A-B may collide the pallet or side faces of the pallet. If the front face collides with the pallet instead of passing through the opening that means that APHA 100 is going/navigating in wrong direction and the corresponding bumper switch gives feedback to the APHA 100 to stop and reverse back a little such that the APHA 100 realigns and enter back in proper direction through the fork opening (e.g., also referred as fork assembly receiver) of the pallet. In other scenario, if the fork assemblies 106A-B have already entered inside the fork opening/fork assembly receiver of the pallet but the side face of the fork assemblies 106A-B is touching the side faces of the fork opening of the pallet in that case the bumper switches positioned on either side of the fork assemblies 106A-B contacting first gives a feedback for navigation to correct itself to enter inside without further contact between the APHA 100 and fork opening receiver of the pallet.

The APHA 100 is operated to enable the first end 108A of the two or more fork assemblies 106A-B to slide through a corresponding fork assembly receiver of a pallet. The expression "fork assembly receiver" herein refers to one or more slots of the pallet (e.g., these slots are typically at the bottom surface of the pallet) that receive one or more fork assemblies of a payload handling apparatus (e.g., the APHA 100 or a conventional fork lifter). When the first end 108A of the two or more fork assemblies 106A-B navigates through a first end and a second end of the corresponding fork assembly receiver of the pallet, the first long double LH RH lead screw mechanism 116A and the second long double LH RH lead screw mechanism 116B operate to (i) lift the top plate 114A and (ii) enable at least one surface of the top plate 114A to contact a bottom surface of the pallet. Upon positioning the pallet on the top plate 114A of each of the two or more fork assemblies 106A-B the autonomous payload handling apparatus 100 navigates to a desired location based on sensory information obtained from one or more sensors attached to the autonomous payload handling apparatus 100.

The chassis assembly 102 further comprises a cross-slide assembly 140. More specifically, the cross-slide assembly 140 is mounted within the chassis assembly 102. FIG. 5A, with reference to FIGS. 1A through 3C, depicts a perspective view of the fork assemblies 106A-B operatively coupled/connected to the cross-slide assembly 140, in accordance with an embodiment of the present disclosure. FIG. 5B, with reference to FIGS. 1A through 3C, depicts a view illustrating connectivity between the fork assemblies 106A-B and the cross-slide assembly 140, in accordance with an embodiment of the present disclosure. The cross-slide assembly 118 comprises a first linear shaft 142A and a second linear shaft 142B. Each of the first linear shaft 142A and the second linear shaft 142B comprises a first linear bearing block 144A and a second bearing block 144B. The corresponding vertical fork plate (e.g., the vertical fork plates 110A-B) of the two or more fork assemblies 106A-B is coupled to the first linear bearing block 144A and the second bearing block 144B via one or more screw mechanisms. When the payload is lifted upward, the top plate 114A is tilted intentionally making the payload also to tilt towards the chassis assembly 102 which further leads the payload to also lean on towards the vertical fork plate 110A-B serving as a back rest. When the APHA 100 is moving on undulated roads/path(s) or when sudden brake is applied in these scenarios the frictional contact between the vertical fork plate 110A-B and payload ensures more rigid support to the payload in all transport conditions.

Figure 6:
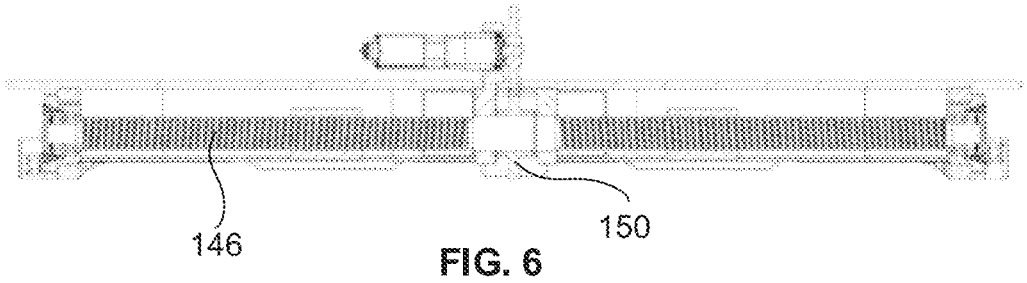
FIG. 6 depicts a sectional view of the cross-slide assembly of the APHA, in accordance with an embodiment of the present disclosure.

The linear bearing block 144A-B provide free motion of the fork assemblies 106A-B along the linear shafts 142A-B and serves as a supporting member for the vertical fork plates 110A-B. The cross-slide assembly 118 further comprise a lead screw shaft 146. The one more screw mechanism comprise, but are not limited to, a plurality of lead screw nuts that are mounted and coupled to the vertical fork plates 110A-B and the thread of the lead screw shaft such the thread of the lead screw nut engages with the thread in lead screw shaft. 146 (due to thread engagement between the shaft and nut, the rotation of the lead screw shaft 146 leads to the movement of the nut in the direction of the axis of the shaft. The lead screw shaft 146 is positioned between the first linear shaft 142A and the second linear shaft 142B. Each of the first linear shaft 142A, the second linear shaft 142B and the lead screw shaft 146 has a first end and a second end. The first end and the second end of the first linear shaft, the second linear shaft, and the lead screw shaft 146 are coupled to a first support block 148A and a second support block 148B, respectively. The first and the second linear shafts 142A-B take downward load and restricts the load being transmitted to the lead screw shaft 146 for ease of rotation). The support blocks 148A-B holding the first and the second end of the first linear shaft, the second linear shaft, and the lead screw shaft 146 increasing the strength of the APHA 100. A follower gear 150 is mounted on the mid-region (or middle area) of the lead screw shaft 146 with a key sandwiched between them. FIG. 6, with reference to FIGS. 1A through 5B, depicts a sectional view of the cross-slide assembly 140 of the APHA 100, in accordance with an embodiment of the present disclosure. The axial movement of the follower gear 150 has been arrested by provisioning of support blocks on either side of the follower gear. The follower gear 150 powers the lead screw shaft with the torque provided by the fork motor.

The chassis assembly 102 further comprises a pair of spring-loaded wheels 152A-B (refer FIG. 1C), each spring-loaded wheel from the pair of spring-loaded wheels 152A-B slides in a first direction and a second direction based on a pre-defined preload. In an embodiment, the first direction is an upward direction, and the second direction is a downward direction. The chassis assembly 102 further comprises an adjustable screw 154 (refer FIG. 7). FIG. 7, with reference to FIGS. 1A through 6, depicts a sectional view of the adjustable screw 154 and the pair of spring-loaded wheels 152A-B comprised in the APHA 100, in accordance with an embodiment of the present disclosure. The adjustable screw 154 (*i*) adjusts height of the pair of spring-loaded wheels 152A-B and (ii) moves the pair of spring-loaded wheels 152A-B in a specific direction (e.g., upward, and/or downward direction). Moving of the pair of spring-loaded wheels 152A-B in the specific direction causes lifting of the autonomous payload handling apparatus 100 such that the autonomous payload handling apparatus 100 rests on a plurality of wheels (e.g., corresponding wheel under each of the fork assemblies 106A-B and steering and drive wheel along with two swivel wheels under the chassis assembly 102. The plurality of wheels is depicted in FIG. 1C. In other words, moving of the pair of spring-loaded wheels 152A-B in the specific direction causes lifting of the autonomous payload handling apparatus 100 for dead vehicle movement (e.g., when the battery is drained or dead and the APHA 100 is not able to operate for navigation and handling of payloads). In above statement 'moving of the pair of spring-loaded wheels 152A-B in the specific direction causes lifting of the autonomous payload handling apparatus 100 such that the autonomous payload handling apparatus 100 rests on a plurality of wheels' is better understood by way of following example. When the spring-loaded wheels are manually moved in the downward direction the drive wheel is automatically lifted up away from the ground causing the whole APHA 100 on fork wheels which are under the fork assemblies 106A-B and swivel wheels. This is realized like a four wheeled cart which can be pulled or pushed manually by a person.

Figure 10A:
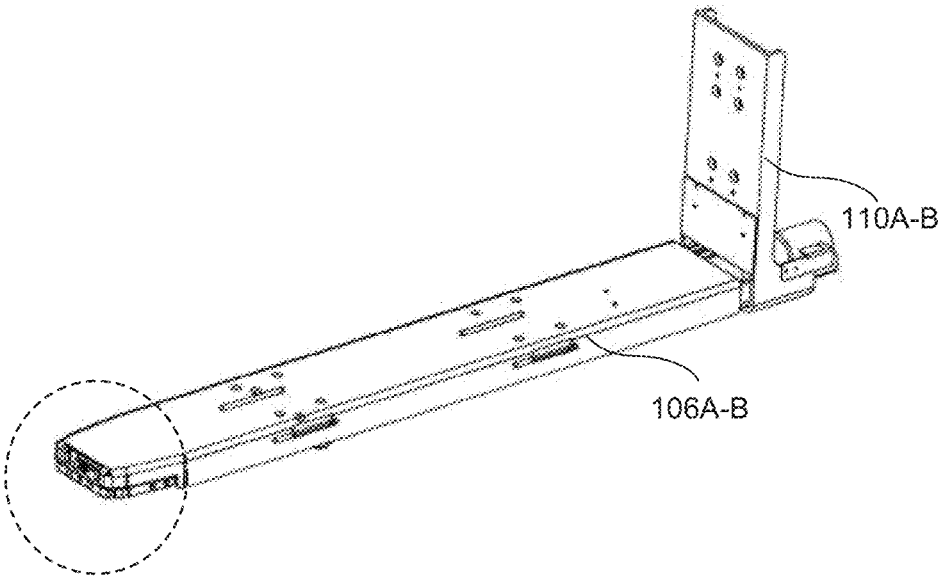
FIG. 10A depicts a tapered design of the first end of the two or more fork assemblies, in accordance with an embodiment of the present disclosure.
Figure 10B:
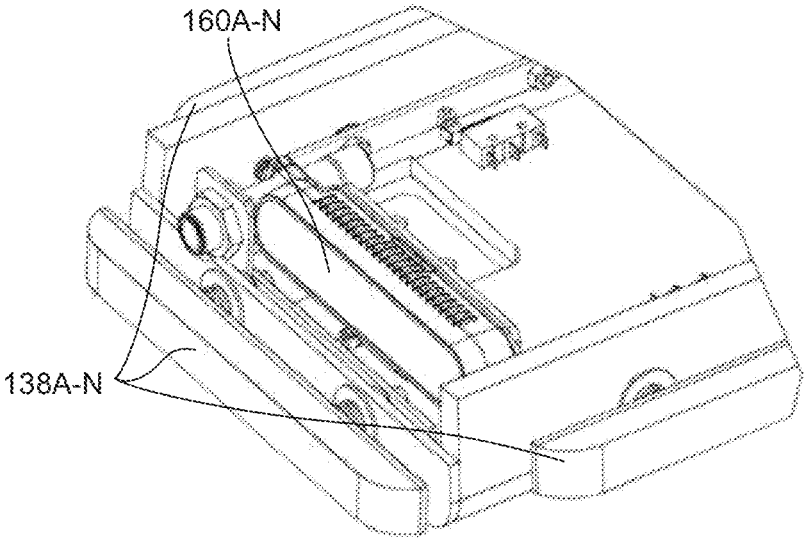
FIG. 10B depict a portion of the two or more fork assemblies illustrating one or more bumper switches and the one or more vision sensors, in accordance with the embodiment of the present disclosure.

The APHA 100 is further quipped with camera (or image capturing devices) and/or one or more vision sensors 160A-N at the first end of the two or more fork assemblies 106A-B. To accommodate such bumper switch(es) and/or vision sensors, design of the two or more fork assemblies 106A-B may or may not be modified. For instance, FIG. 10A, with reference to FIGS. 1A through 9E, depicts a tapered design of the first end 108A of the two or more fork assemblies 106A-B, in accordance with an embodiment of the present disclosure. Such tapered fork assembly may be referred as chamfered fork assembly and may be interchangeably used herein. FIG. 10B, with reference to FIGS. 1A through 10A, depict a portion of the two or more fork assemblies 106A-B illustrating the corresponding bumper switches 138A-N and the one or more vision sensors 160A-N, in accordance with the embodiment of the present disclosure. When the two or more fork assemblies 106A-B slide through the corresponding fork assembly receiver of the pallet via sensor data obtained from the vision sensors, the one or more corresponding bumper switches 138A-N determine whether there is an offset between the two or more fork assemblies 106A-B and the corresponding fork assembly receiver of the pallet. In other words, based on the sensor data the APHA navigates from one location to other/desired location. During navigation from one location to another location or during entry of the fork assemblies 106A-N in the corresponding fork assembly receiver of the pallet, there could be a possibility of surface of the fork assemblies 106A-B coming in contact with surface of the corresponding fork assembly receiver. Such contact results in the determination of offset by the APHA 100. The bumper switches then calculate a navigating angle based on the offset. In other words, the navigating angle is indicative of by how much angle or distance there needs to be a course correction/navigation correction to prevent any further contact between the surfaces of the fork assemblies 106A-B and corresponding fork assembly receiver of the pallet. Once the navigating angle is calculated by the APHA 100 or the bumper switches, the bumper switches pass the navigating angle information to the APHA 100 wherein the APHA 100 corrects the offset based on the navigating angle, (smoothly) slides through the corresponding fork assembly receiver of the pallet and further reduces frictional contact between the two or more fork assemblies and the pallet or the receiver of the pallet. In the present disclosure, the APHA 100 has been equipped/integrated with two vision sensors. In other words, each of the fork assemblies 106A-B is mounted with at least one vision sensor. The sensor data from both the vision sensors are fused by the APHA 100 to form a wide angle thus enabling better offset determination, and course correction for navigation. The fusion of the sensor data obtained from both the vision sensors may be performed by one or more hardware processors. The one or more hardware processors may be either externally connected to the APHA 100 or are integral components of the APHA 100. The connectivity of the hardware processor(s) to (i) the APHA, (ii) the vision sensors and (iii) the bumper switches is realized via one or more input/output communication interfaces (as known in the art interfaces such as a serial bus, and the like).

The APHA 100 further comprises one or more cable path cover brackets that are mounted at the side surface of the bottom plate 114B to safely route the vision sensors and limit switch cables from the second end to the first end of the lead screw mechanisms and into the vertical fork plates without interfering with the fork-lifting mechanism or physical contact with the fork motor. In the present disclosure, the cable cover brackets are used as conduit for electrical wirings.

FIG. 8, with reference to FIGS. 1A through 7, depicts a sectional view of the fork assemblies 106A-B in a lifted position, in accordance with an embodiment of the present disclosure. Lifting of the fork assemblies 106A-B is better understood by way of following description. For every payload type to be lifted there is a predetermined lift height. The fork assemblies 106A-B are initially at the collapsed position. Depending on the lift height the top plate 114A of fork assemblies 106A-B is lifted upward thus lifting the payload. Within the APHA 100, the fork motor 126 turns as many revolutions as required for lift. Since the fork motor 126 is directly coupled with lead screw shaft comprised in the first and second long double LH RH lead screw mechanism 116A-B, the lead screw shaft rotates for the same corresponding number of revolutions. This causes a corresponding nut comprised therein to move in the linear direction parallel to the base of the fork assemblies 106A-B. The first and second long double LH RH lead screw mechanism 116A-B have a combination of one LH and one RH screw and the plurality of threaded blocks 124A-N such that both of them travel linearly in opposite directions i.e., closer to each other. Each of the plurality of threaded blocks 124A-N is having a connection with one or more corresponding links 130A-N, they move closer. The other end of the one or more corresponding links 130A-N is coupled to the top plate 114A which is made to move upward due to one or more corresponding links 130A-N moving upwards.

The APHA 100 may be operated based on instructions set comprised in a system (e.g., the system is either within the APHA 100 or externally connected to the APHA 100 via I/O communication interfaces). For executing the instructions set(s) as mentioned above, the APHA 100 may comprise (or comprises) the system (not shown in FIGS.) that includes a memory for storing instructions set(s), one or more input/output communication interfaces interface(s), one or more hardware processors. The one or more hardware processors are communicatively coupled to the memory via the one or more communication interfaces wherein the one or more hardware processors are configured by the instructions to execute and enable operation of each component of the APHA 100 as described herein. More specifically, the movement of the APHA 100, the fork assemblies 106A-B operation and the working of the other components comprised in the APHA 100 as described above may be based on instructions set being executed by the one or more hardware processors for handling payload (either placed on the pallet or to be placed on the pallet). Various components of the APHA 100 are configured by the instructions set to perform the method described herein for handling the payload. The system may be mounted on the APHA 100, in one example embodiment of the present disclosure. The system may be housed on the APHA 100, in another example embodiment of the present disclosure. The system may be comprised in the APHA 100, in yet another example embodiment of the present disclosure. The system may be communicatively coupled to the apparatus 100 via one or more communication interfaces as applicable and known in the art, in yet further example embodiment of the present disclosure. In such scenarios where it is communicatively coupled to the APHA 100, the APHA 100 may be provisioned with options and configured with suitable arrangement such that the apparatus can be operated via the connected/communicatively coupled system.

The written description describes the subject matter herein to enable any person skilled in the art to make and use the embodiments. The scope of the subject matter embodiments is defined by the claims and may include other modifications that occur to those skilled in the art. Such other modifications are intended to be within the scope of the claims if they have similar elements that do not differ from the literal language of the claims or if they include equivalent elements with insubstantial differences from the literal language of the claims.

It is to be understood that the scope of the protection is extended to such a program and in addition to a computer-readable means having a message therein; such computer-readable storage means contain program-code means for implementation of one or more steps of the method, when the program runs on a server or mobile device or any suitable programmable device. The hardware device can be any kind of device which can be programmed including e.g. any kind of computer like a server or a personal computer, or the like, or any combination thereof. The device may also include means which could be e.g. hardware means like e.g. an application-specific integrated circuit (ASIC), a field-programmable gate array (FPGA), or a combination of hardware and software means, e.g. an ASIC and an FPGA, or at least one microprocessor and at least one memory with software processing components located therein. Thus, the means can include both hardware means and software means. The method embodiments described herein could be implemented in hardware and software. The device may also include software means. Alternatively, the embodiments may be implemented on different hardware devices, e.g. using a plurality of CPUs.

The embodiments herein can comprise hardware and software elements. The embodiments that are implemented in software include but are not limited to, firmware, resident software, microcode, etc. The functions performed by various components described herein may be implemented in other components or combinations of other components. For the purposes of this description, a computer-usable or computer readable medium can be any apparatus that can comprise, store, communicate, propagate, or transport the program for use by or in connection with the instruction execution system, apparatus, or device.

The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope and spirit of disclosed embodiments being indicated by the following claims.

What is claimed is:

1. An autonomous payload handling apparatus, comprising:

a chassis assembly comprising:

one or more friction pads, wherein each of the one or more friction pads is attached to at least one side of the chassis assembly;

two or more fork assemblies coupled to the chassis assembly, wherein each of the two or more fork assemblies comprises a first end and a second end, wherein the second end of the two or more fork assemblies is coupled to a bottom end of the chassis assembly, wherein each of the two or more fork assemblies comprises a corresponding vertical fork plate, wherein the corresponding vertical fork plate comprises a first surface and a second surface, and wherein each of the two or more fork assemblies comprises a top plate and a bottom plate;

a first long double left-hand (LH) right-hand (RH) lead screw mechanism and a second long double left-hand (LH) right-hand (RH) lead screw mechanism, wherein the first long double LH RH lead screw mechanism is accommodated within a first fork assembly of the two or more fork assemblies, and wherein the second long double LH RH lead screw mechanism is accommodated within a second fork assembly of the two or more fork assemblies;

a cross-slide assembly mounted within the chassis assembly, wherein the cross-slide assembly comprises:

a first linear shaft and a second linear shaft, wherein each of the first linear shaft and the second linear shaft comprises a first linear bearing block and a second bearing block, wherein the corresponding vertical fork plate of the two or more fork assemblies is coupled to the first linear bearing block and the second bearing block respectively via one or more screw mechanisms; and a lead screw shaft positioned between the first linear shaft and the second linear shaft, wherein a first end and a second end of each of the first linear shaft, the second linear shaft, and the lead screw shaft are coupled to a first end and a second end of each of a first support block and a second support block, respectively, wherein the autonomous payload handling apparatus is operated to enable the first end of the two or more fork assemblies to slide through a corresponding fork assembly receiver of a pallet, wherein when the first end of the two or more fork assemblies navigates through a first end and a second end of the corresponding fork assembly receiver of the pallet, the first long double LH RH lead screw mechanism and the second long double LH RH lead screw mechanism are operated to (i) lift the top plate and (ii) enable at least one surface of the top plate to contact a bottom surface of the pallet, and wherein upon positioning the pallet on the top plate of each of the two or more fork assemblies the autonomous payload handling apparatus navigates to a desired location based on sensory information obtained from one or more sensors attached to the autonomous payload handling apparatus; and a plurality of limit switches, wherein each of the plurality of limit switches is configured to control position of the two or more fork assemblies.

2. The autonomous payload handling apparatus of claim 1, wherein each of the two or more fork assemblies comprises a plurality of plummer blocks, wherein a first plummer block of the plurality of plummer blocks is operatively connected to a first end of the first long double LH RH lead screw mechanism and the second long double LH RH lead screw mechanism respectively, wherein a second plummer block of the plurality of plummer blocks is operatively connected to a second end of the first long double LH RH lead screw mechanism and the second long double LH RH lead screw mechanism respectively, and wherein a third plummer block of the plurality of plummer blocks is operatively connected in the middle of the first long double LH RH lead screw mechanism and the second long double LH RH lead screw mechanism respectively to prevent the first long double LH RH lead screw mechanism and the second long double LH RH lead screw mechanism from buckling.

3. The autonomous payload handling apparatus of claim 2, wherein each of the plurality of plummer blocks comprises a bearing unit, wherein the bearing unit comprises at least one of one or more axial load bearings and one or more radial load bearings, and wherein the bearing unit is configured to convert vertical payload placed on the pallet as a radial payload.

4. The autonomous mobile payload handling apparatus of claim 1, wherein each of the first long double LH RH lead screw mechanism and the second long double LH RH lead screw mechanism is configured to convert rotation of a fork motor comprised in the two or more fork assemblies into a linear translation of a plurality of threaded blocks comprised therein.

5. The autonomous payload handling apparatus of claim 4, wherein when each of the one or more threaded blocks is engaged with one or more linear bearings comprised therein, each of the one or more linear bearings is configured to slide and enable anti-rotation and linear motion of the plurality of threaded blocks.

6. The autonomous payload handling apparatus of claim 4, wherein an inward motion of the plurality of threaded blocks enables the corresponding central pin connected to the upper end of the corresponding link to move in an upward direction, and wherein movement of the corresponding central pin in the upward direction causes the top plate of the two or more fork assemblies to move in a desired direction.

7. The autonomous payload handling apparatus of claim 4, wherein each of the plurality of threaded blocks comprises a protrusion, wherein the protrusion is configured to accommodate a plain bearing, and wherein the plain bearing is configured to reduce friction between (i) the protrusion, and (ii) one or more corresponding links mounted on the protrusion, and wherein a corresponding central pin is connected on an upper end of a corresponding link of the one or more corresponding links.

8. The autonomous payload handling apparatus of claim 7, wherein length of the one or more corresponding links enables (i) an angular tilt of the top plate along with a vertical lift of the pallet with respect to the bottom plate, or (ii) lifting of a payload in parallel with the bottom plate of the two or more fork assemblies.

9. The autonomous payload handling apparatus of claim 7, wherein length of the one or more corresponding links prevents a dead lock of the two or more fork assemblies and reduces slackness thereof based on a pre-defined angle of the one or more corresponding links.

10. The autonomous payload handling apparatus of claim 7, wherein the fork motor comprises a sensor feedback for controlled movement of the one or more corresponding links to lift a payload placed on the pallet.

11. The autonomous payload handling apparatus of claim 1, further comprising a plurality of spring-loaded bumpers, wherein each of the plurality of spring-loaded bumpers is connected to a corresponding bumper switch, and wherein the corresponding bumper switch is configured to enable navigation and locate the pallet or one or more objects during the navigation.

12. The autonomous payload handling apparatus of claim 11, wherein the corresponding bumper switch is mounted at the first end of the two or more fork assemblies, wherein when the two or more fork assemblies slide through the corresponding fork assembly receiver of the pallet, the corresponding bumper switch is configured to:

(i) determine an offset between the two or more fork assemblies and the corresponding fork assembly receiver of the pallet;

(ii) calculate a navigating angle based on the offset; and (iii) enable the autonomous payload handling apparatus to correct the offset based on the navigating angle and slide through the corresponding fork assembly receiver of the pallet and further reduce frictional contact between the two or more fork assemblies and the pallet.

13. The autonomous payload handling apparatus of claim 1, wherein the chassis assembly further comprises:

a pair of spring-loaded wheels, each spring-loaded wheel from the pair of spring-loaded wheels is configured to (i) slide in a first direction and a second direction based on a predefined preload; and an adjustable screw that is configured to (i) adjust height of the pair of spring-loaded wheels and (ii) move the pair of spring-loaded wheels in a specific direction, wherein moving of the pair of spring-loaded wheels in the specific direction causes lifting of the autonomous payload handling apparatus such that the autonomous payload handling apparatus rests on a plurality of wheels.

14. The autonomous payload handling apparatus of claim 1, wherein a first pair of threaded blocks from the plurality of threaded blocks is positioned at a first end of each of the first long double LH RH lead screw mechanism and the second long double LH RH lead screw mechanism, and wherein a second pair of threaded blocks from the plurality of threaded blocks is positioned at a second end of each of the first long double LH RH lead screw mechanism and the second long double LH RH lead screw mechanism.

15. The autonomous payload handling apparatus of claim 1, wherein each of the first long double LH RH lead screw mechanism and the second long double LH RH lead screw mechanism comprises another lead screw shaft with a first thread, a second thread, a third thread and a fourth thread.

16. The autonomous payload handling apparatus of claim 15, wherein the first thread, and the fourth thread have an outer diameter that is less than an inner diameter of one or more threaded blocks mounted on the second thread and the third thread.

* * * * *